US005275175A

United States Patent [19]

Poirier et al.

[11] Patent Number: 5,275,175

[45] Date of Patent: Jan. 4, 1994

[54] POSTURAL DRAINAGE TABLE

[76] Inventors: Sylvain Poirier, 109 Des Iles Percées Street, Boucherville, Quebec, Canada, J4B 2P3; Julie Trépanier, 150 De Navare Street, St-Lambert, Quebec, Canada, J4S 1R6

[21] Appl. No.: 931,364

[22] Filed: Aug. 18, 1992

[51] Int. Cl.[5] ..... A61G 15/00

[52] U.S. Cl. ..... 128/845; 5/610

[58] Field of Search ..... 128/845; 5/610, 607, 5/608, 620; 602/35, 34; 606/240, 241, 244; 269/322-326

[56] References Cited

U.S. PATENT DOCUMENTS

| | | | |
|---|---|---|---|
| 2,816,806 | 12/1957 | Zaalberg | 5/610 |
| 3,525,308 | 8/1970 | Koopmans | 5/610 |
| 3,532,882 | 10/1970 | Craig | 5/610 |
| 3,851,870 | 12/1974 | Cook | 5/620 |
| 3,879,796 | 4/1975 | Whyte | 5/620 |
| 4,013,019 | 3/1977 | Horsey | 5/610 |
| 4,164,656 | 8/1979 | Krasznai | 5/610 |
| 4,579,323 | 4/1986 | Brendl | 5/610 |
| 4,650,172 | 3/1987 | Wathelet | 5/610 |

*Primary Examiner*—Michael A. Brown

[57] ABSTRACT

A postural drainage table for supporting a person at various angular positions for treatment. The table comprises a support frame and a pivotal table support member guidingly supported and connected to the support frame. A table platform is secured to the support member for supporting a patient thereon. A pivot pin connects the support frame and the support member to permit displacement of the support member along a pivotal path. A locking mechanism is also provided to lock the support member in the desired position relative to the support frame to position the platform at a desired angle.

10 Claims, 3 Drawing Sheets

POSTURAL DRAINAGE TABLE

TECHNICAL FIELD

The present invention relates to a postural drainage table for supporting a person at various angular positions for treatment.

BACKGROUND ART

People inflicted with various respiratory disorders, such as cystic fibrosis, are given periodic treatments which consists in imparting clapping and/or vibratory impacts on specific portions of a person's upper body including both back and front, and while the person is disposed at various angular positions to help in the drainage of the respiratory system. U.S. Pat. No. 3,601,122 issued on Aug. 24, 1971 describes a postural drainage assister positioning various parts of a person's body at specific angles to assist in the drainage of mucous and fluids from the lungs and through the patient's throat. The device as disclosed in that patent is adapted for individual use so that a person can apply a self-treatment with a maneuverable vibratory percussion tool which is attached to the device. Usually such treatments are given at hospitals or at clinics by trained personnel, but in recent years percussion devices have been developed which greatly facilitates self-treatment. This provides various advantages to the patient as he can treat himself in his own dwelling and does not have to set up appointments and displace himself each time a treatment is necessary. A reduction of considerable time and expenses are therefore achieved by this self-treatment.

Various respiratory diseases also require specialized treatments, and it is important to position the body in a specific way dependent on the treatment. The body may have to be positioned with the upper part of the body inclined upwardly, horizontally, or downwardly.

SUMMARY OF INVENTION

It is a feature of the present invention to therefore provide a postural drainage table for supporting a person at various angular positions for treatment and wherein the table can be disposed at various angles provided with easy adjustment means to vary the angles of the support platform.

Another feature of the present invention is to provide a postural drainage table which is easy to use and relatively economical so that it can be used in the home.

Another feature of the present invention is to provide a postural drainage table wherein the table support platform is displaceable to an elevated position and retained at that position.

Another feature of the present invention is to provide a postural drainage table for home use and which can also serve as an article of furniture.

According to the above features, from a broad aspect, the present invention provides a postural drainage table for supporting a person at various angular positions for treatment. The table comprises a support frame and a pivotal table support member guidingly supported and connected to the support frame. A table platform is secured to the support member for supporting a patient thereon. A mechanical pivot means is connected to the support frame for retention of the support member and permits displacement of the support member along a pivotal path. Arresting means is provided for locking the support member at a desired position relative to the support frame to position the platform at a desired angle.

BRIEF DESCRIPTION OF DRAWINGS

A preferred embodiment of the present invention will now be described with reference to the accompanying drawings in which.

DESCRIPTION OF PREFERRED EMBODIMENTS

Figure 3:
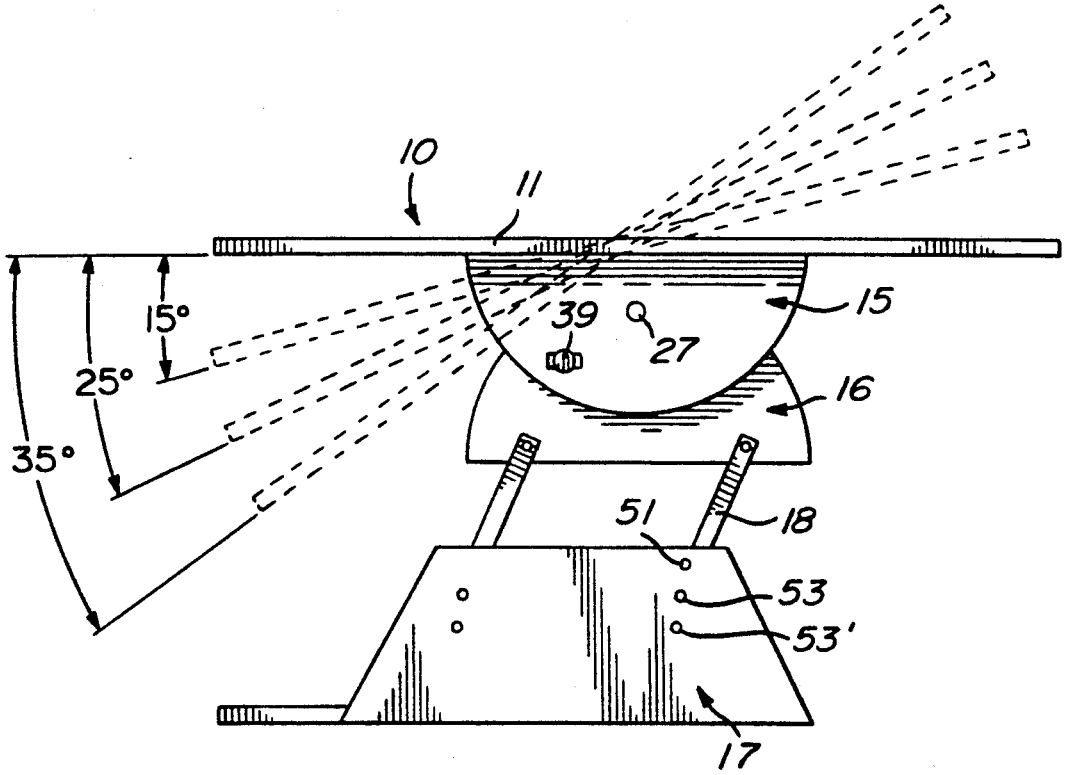
FIG. 3 is a side view showing the table in an elevated position and showing the various angular displacements of the table platform.
Figure 4:
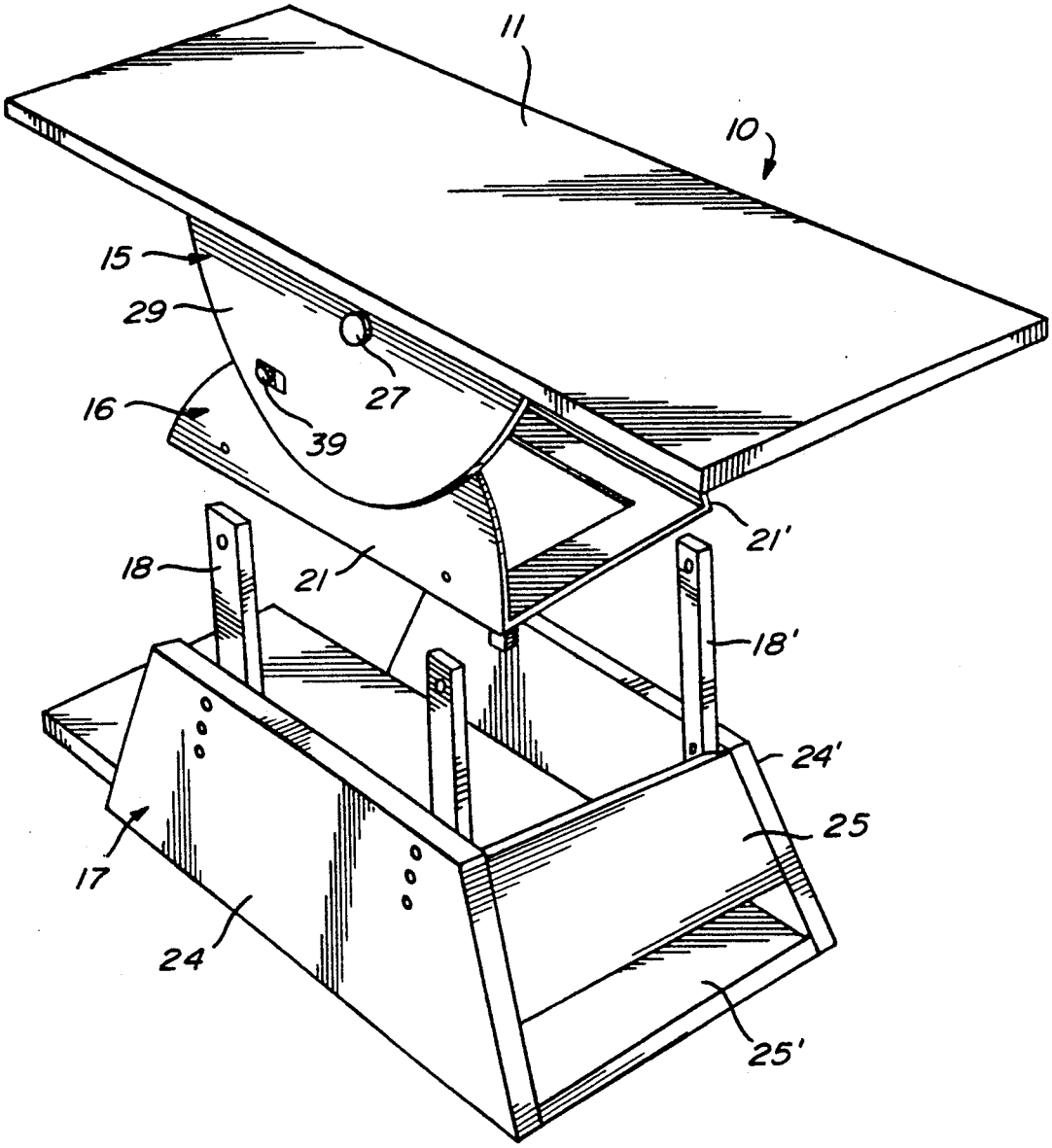
FIG. 4 is a perspective view showing the support frame and table platform disconnected from the support base.

Referring now to the drawings, there is shown generally at 10 the postural drainage table of the present invention for supporting a patient at various angular positions of drainage of the lungs when a patient is inflicted with a respiratory disease, such as cystic fibrosis, bronchitis, emphysema, etc. The drainage table comprises a top table platform 11 which may be comprised of a single board. The table platform 11 is herein shown as secured to a pivotal table support member 15 which is guidingly supported and connected to a support frame 16. The support frame 16 may be connected to a support base 17 by a hinge mechanism comprising pairs of lever arms 18 to support the support frame 16 and table platform 11 at a higher elevation, as shown in FIG. 3.

Figure 1:
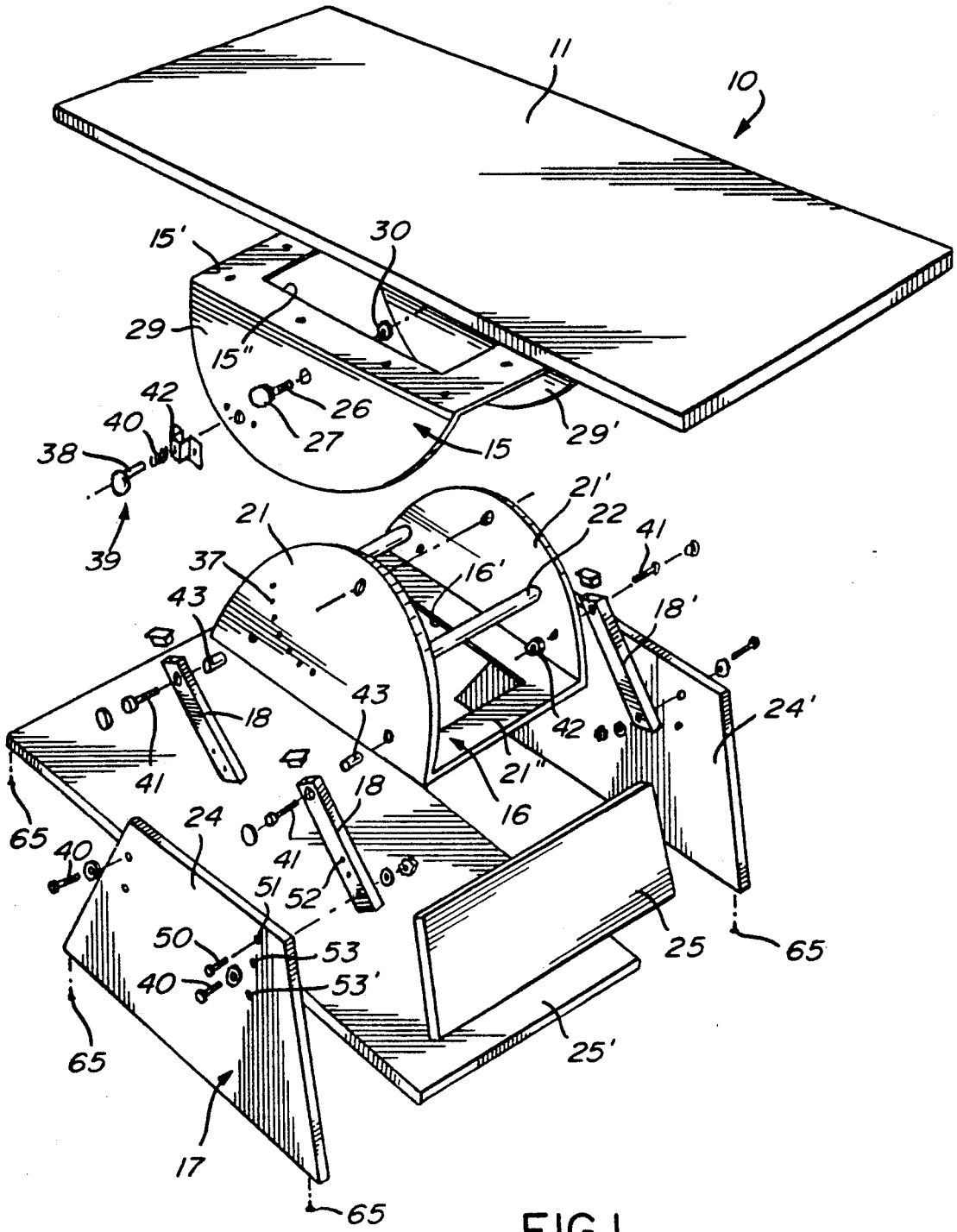
FIG. 1 is a perspective exploded view showing the construction of the postural drainage table of the present invention.

As more clearly illustrated in FIG. 1, the pivotal table support member 15 is a half-round reversed U-shaped or accurately shaped flat member formed of sheet metal or plywood or plastic material. Its upper face 15' has a rectangular hole 15'' for reducing the weight thereof. The support frame 16 is comprised of a U-shaped part with two parallel vertical half-round walls 21 and 21', a bottom wall 21'' with a rectangular hole 16' and cross members 22, herein metal bars mechanically connected to the vertical walls 21 and 21' of the support frame 16. The bars may also help a person lying on the platform to maintain his balance when changing platform angles. The support base 17 is also provided with opposed parallel spaced wall members 24 and 24' interconnected by 25 and 25'. The wall members 21 and 21' of the support frame are spaced apart a distance to fit between the wall members 24 and 24' of the support base 17. The support frame 16 is detachably secured to the support base, as will be described later.

As also shown in FIG. 1, the pivotal displacement is assured by an axis 26 made of a threaded cylindrical metal rod mechanically joined to a handle knob 27. The axis passes through the support member 15 and the support frame 16, and is then connected to a nut 30 for adjusting the friction of the pivoting displacement.

One of the side walls of the support frame 16 is provided with spaced apart holes 37 which receive the locking end 38 of a lock pin 39 secured to wall member 29 of the support member 15 and spring-biased by the helical spring 40 which is positioned thereabout and secured to the pin 39 to bias is forwardly through a guide housing 42 mounted in the wall member 29. The locking end 38 of the locking pin 39 is engageable within the selected one of the holes 37 to retain the support member 15 at a desired position to support the platform 11 at a desired angle.

FIG. 3 illustrates various positions of the table platform that are required to be maintained during a postural draining treatment and, as herein shown, these angles can be quite severe, therefore making it important for the angular support frame to be very rigid and easily displaceable. The present pivotal frame construction does provide such features.

As previously described, the support frame may be displaceably secured to the base 17 by levers 18 should it be desired to position the support frame and platform at an elevation, and this is often required when a treatment is given to children. It is also pointed out that the support frame of the present invention is removably connected to the support base and may easily be detached therefrom. This permits ease of transportation of the postural drainage table and also permits the support frame to be utilized independently of the support base. The postural drainage table can serve as an article of furniture, i.e., a coffee table when supported solely by the support frame 16 or the combination with the support base 17.

Figure 2:
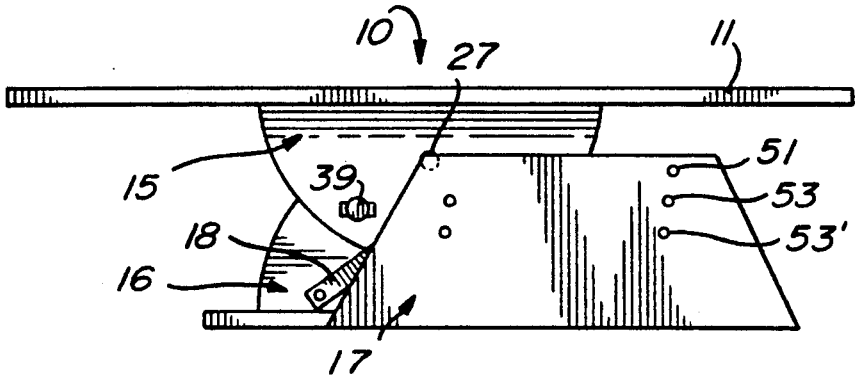
FIG. 2 is a side view showing the table at a lowered position.

The lever connections 18 will now be described. As shown in FIG. 1 there are four straight lever arms 18 each of which is pivotally connected adjacent the lower end by pivot pins 40 to wall member 24 or 24' of the support base 17 through a hole 53 or 53'. The presence of two or more holes provides various height settings of the table when at its elevated position. The pairs of lever arms 18 and 18' are top end to a hole in wall members 21 and 21' of the support frame 16 by a pivot pin 41 which is secured by a lock nut 42. A spacer 43 is placed between wall members 21 and 21' and the top end of lever arms 18 and 18' so as to provide clearing for the movement of the lever arms to displace the support frame 16 from a lower position where it rests on the bottom wall 25' of the support base 17, as shown in FIG. 2, to an elevated position, as shown in FIG. 3.

As can be seen, the support frame 16 is also easily disconnected from the base 17 by simply removing the lock nuts 42 and pivot pins 41, and lifting the support frame from the lever arms. This is done with the support frame elevated for access to the pins 41, and this also provides ease of removal of the support frame since it is already elevated.

Lock pins 50 may also be associated with one of the lever arms to immovably lock it in an elevated position. These lock pins would extend through a hole 51 provided in the opposed wall members 24 and through a further hole 52 provided in the lever arms 18. This would provide for added security so that the support frame 16 would not be caused to return to its lowered position accidentally by the patient's movement supported on the platform 11.

It is also within the ambit of the present invention to provide an adjustable hinge connection between end sections of the platform 11. Support legs 65 may also be provided, as shown, in the lower edge of the support base 17 and the lower edge of the support frame 16 (not shown), and these legs may also be made adjustable if it is desired to have the platform lying in a substantially perfect horizontal level plane. Other obvious modifications are intended to be covered by the present invention provided such is construable within the scope of the protection defined in the appended claims.

We claim:

1. A postural drainage table for supporting a person at various angular positions for treatment, said table comprising a support frame, a support member guidingly supported and connected to said support frame, a table platform secured to said support member for supporting a patient thereon, pivot support means connected to said support frame and having a pivot axis for retention of said support member and permitting displacement of said support member around said pivot axis, arresting means for locking said support member at a desired position relative to said support frame to position said platform at a desired angle, said support frame being displaceably secured to a base by pivotal lever connections to position and retain said support frame and said table platform at a selected one of two or more elevated positions above said base, and holding means connected to said pivotal lever connections and said base to retain said support frame and table platform at said selected elevated position.

2. A postural drainage table as claimed in claim 1 wherein said support member is a reverse U-shaped member having opposed accurate flat walls; said pivot support means comprising a pivot pin having lock means engageable at a free end thereof, said pivot pin permitting frictional control of the pivotal movement of said support member.

3. A postural drainage table as claimed in claim 2 wherein said arresting means comprises a lock pin secured to said support member and engageable with said support frame to retain same at said desired position.

4. A postural drainage table as claimed in claim 3 wherein said lock pin is spring biased against a locking face of said support frame, said locking face having a plurality of spaced apart holes therein and positioned to lock said support frame with said platform lying at precise angles or in a horizontal plane.

5. A postural drainage table as claimed in claim 2 wherein said support frame is removably connected to a support base, and wherein lever connecting means is provided to position and support said support frame elevated.

6. A postural drainage table as claimed in claim 5 wherein said lever connecting means also provides for positioning said support frame on a floor surface adjacent said support base so that said table platform may be used as an article of furniture.

7. A postural drainage table as claimed in claim 2 wherein said lock means is a lock nut, said pivot pin being comprised by a threaded bolt having a finger engageable end lying outside said walls, said lock nut adjusting said friction between said accurate walls and opposed walls of said support member.

8. A postural drainage table as claimed in claim 1 wherein said holding means is a pivot pin mechanically fixed to said lever connections when said support frame is displaced to said elevated position.

9. A postural drainage table as claimed in claim 1 wherein said holding means is a lock pin connecting a lever bar of said lever connections to said base when said support frame is displaced to said elevated position.

10. A postural drainage table as claimed in claim 1 wherein said base comprises a pair of spaced apart parallel vertical wall members interconnected together, said support frame also having a pair of spaced apart parallel vertical wall members interconnected together, said wall members of said support frame being spaced for close fit between said wall members of said base, said lever connections comprising opposed lever arms pivotally connected at opposed ends to a respective one of said wall members of said support frame and said base.

* * * * *